US005367973A

United States Patent [19]

Heggertveit

[11] Patent Number: 5,367,973

[45] Date of Patent: Nov. 29, 1994

[54] HELICOPTER DECK

[76] Inventor: Fredrik Heggertveit, Oscar Hansens vei 7, N-6400 Molde, Norway

[21] Appl. No.: 94,020

[22] PCT Filed: Jan. 20, 1992

[86] PCT No.: PCT/NO92/00011

§ 371 Date: Jul. 26, 1993

§ 102(e) Date: Jul. 26, 1993

[87] PCT Pub. No.: WO92/12894

PCT Pub. Date: Aug. 6, 1992

[30] Foreign Application Priority Data

Jan. 25, 1991 [NO] Norway ..... 910308

[51] Int. Cl.[5] ..... B63B 35/50

[52] U.S. Cl. ..... 114/261; 114/85

[58] Field of Search ..... 114/85, 258, 261, 262; 52/65

[56] References Cited

U.S. PATENT DOCUMENTS

| | | | |
|---|---|---|---|
| 2,329,941 | 9/1943 | Posin | 114/261 |
| 3,516,375 | 6/1970 | Charlton | 114/261 |
| 3,785,316 | 1/1974 | Leming et al. | 114/261 |
| 4,665,857 | 5/1987 | Akerman et al. | 114/261 |

FOREIGN PATENT DOCUMENTS

| | | | |
|---|---|---|---|
| 60-107494 | 6/1985 | Japan . | |
| 469554 | 7/1937 | United Kingdom . | |
| 0197805 | 5/1978 | United Kingdom | 114/261 |

*Primary Examiner*—Sherman Basinger
*Attorney, Agent, or Firm*—Browdy and Neimark

[57] ABSTRACT

A helicopter deck for a ship, having a greater transverse extension than the breadth of the ship, comprises a level, horizontal deck section (1) attached to the ship (4), the longitudinal edges (15) of which lie entirely or almost entirely within the outer confines of the ship. Along at least one of the longitudinal edges (15) of the permanent deck section (1) is movably disposed a sheet-like deck section (2 or 3) which is tightly joined at one longitudinal edge (16) thereof to the edge (16) of the permanent deck section (1). The outer free edge of the sheet-like deck section (2 or 3) projects substantially beyond the side of the ship. The sheet-like deck section(s) (2,3) may be raised to a position above the permanent deck section (1) and is/are rotatable in this position, the center of rotation (5,6) being located such that the sheet-like section (2 or 3) in its rotated position is situated within or substantially within the sides of the side.

7 Claims, 2 Drawing Sheets

HELICOPTER DECK

BACKGROUND OF THE INVENTION

1. Technical Field

The present invention relates to a helicopter deck for a ship, having a greater transverse extension than the breadth of the ship.

If a helicopter deck is to be mounted on a ship, it may often be necessary for said deck to have a greater transverse extension than the breadth of the ship. This may be either be because a very large helicopter deck is required for various reasons, or because the ship that is to support the helicopter deck is relatively narrow.

2. Prior Art

Helicopter decks have been built on smaller vessels where the sides of the deck have extended beyond the sides of the ship. This is in many ways an unfavorable solution. First, the projecting parts of the helicopter deck would be in the way when the ship is to come along quay, and the wide design would have an unfavorable effect on the stability of the ship, and would be exposed to snow, ice and wind.

From U.S. Pat. No. 4,665,857 there is known a helicopter deck for a ship that consists of a deck section that may be raised and lowered, which section in raised position forms a central part of a helicopter deck that has been expanded on both sides with horizontally movable deck sections. The central deck section may be lowered, e.g., with a helicopter standing thereon, and the horizontally movable deck sections are moved inward over the central deck section, thus forming a type of hangar for the helicopter. This is obviously a very expensive and complicated solution, although it may seem elegant.

There are also known other simpler solutions for expandable decks wherein expanding deck sections are hinged to the longitudinal sides of a central deck. Such an arrangement is also complicated in that it requires very solid hinges and complicated pivot devices for the expanding deck sections.

OBJECT AND SUMMARY OF THE INVENTION

The intention of the present invention is to provide a helicopter deck for a ship, having a greater transverse extension than the breadth of the ship and having a simple, inexpensive and sturdy design, thus eliminating the previous disadvantages.

This is achieved according to the invention by a helicopter deck that is characterized by a level, horizontal deck section attached to the ship, the longitudinal edges of which lie entirely or almost entirely within the outer confines of the ship, that there is disposed along at least one of the longitudinal edges of the level, horizontal and permanent deck section a sheet-like deck section which at one longitudinal edge is tightly joined to a longitudinal edge on the permanent deck section, that the outer, free edge of the sheet-like deck section projects substantially beyond the side of the ship, that the sheet-like deck section may be raised to a position above the permanent deck section and in this raised position is rotatable about an approximately vertical axis, and that the center of rotation is located such that the sheet-like deck section in its rotated position is situated within or approximately within the sides of the ship.

The advantage of the design according to the invention is that it is simple, inexpensive and sturdy and, most importantly, reliable. For rearrangement of the movable deck sections there may be used standard elements such as crane pillars and a toothed flywheel rim driven by a standard motor with gear wheels. In operative position the movable deck sections rest against permanent supports on the ship in addition to the crane pillars. In a simple manner, one can ensure that the movable deck sections in their stowed position are situated within the outer confines of the ship, whereas with a simple raising and rotation they expand the deck substantially in the transverse direction of the ship.

Whether one uses a rotatable deck section on two sides of the deck or on only one side is determined according to need and the breadth of the ship.

In the following the invention will be explained further with reference to the drawings, which show an embodiment form of the invention.

DETAILED DESCRIPTION OF THE PREFERRED EMBODIMENT(S) OF THE INVENTION

Figure 1:
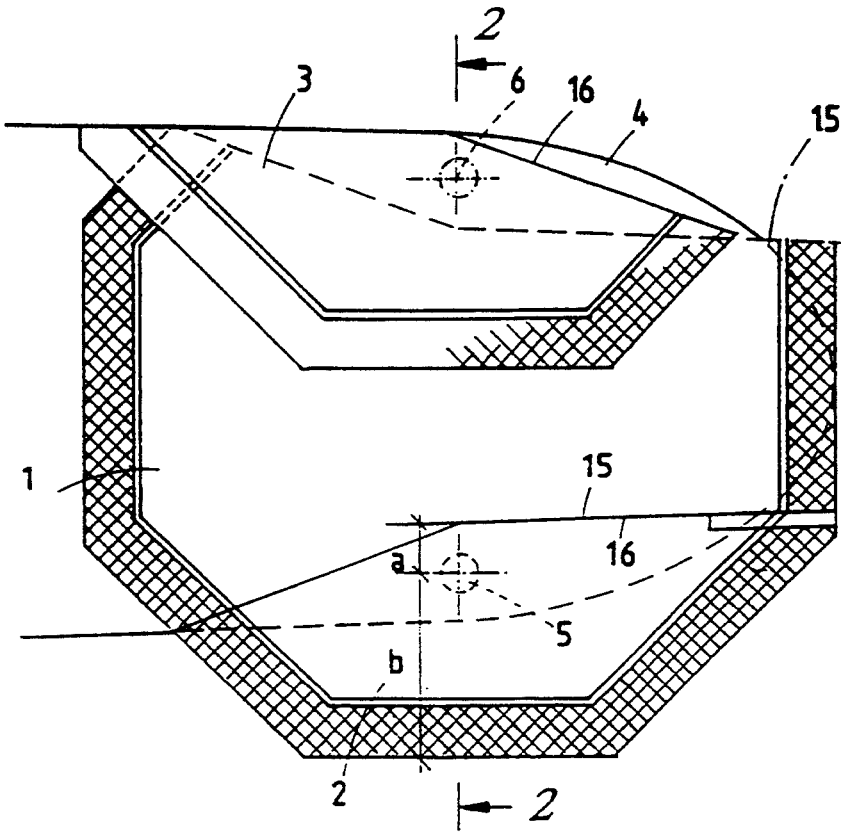
FIG. 1 shows the helicopter deck according to the invention viewed from above. Here, it is shown on the fore deck, but it may be adapted to almost any part of the ship—as well as to various heights above the sea.
Figure 2:
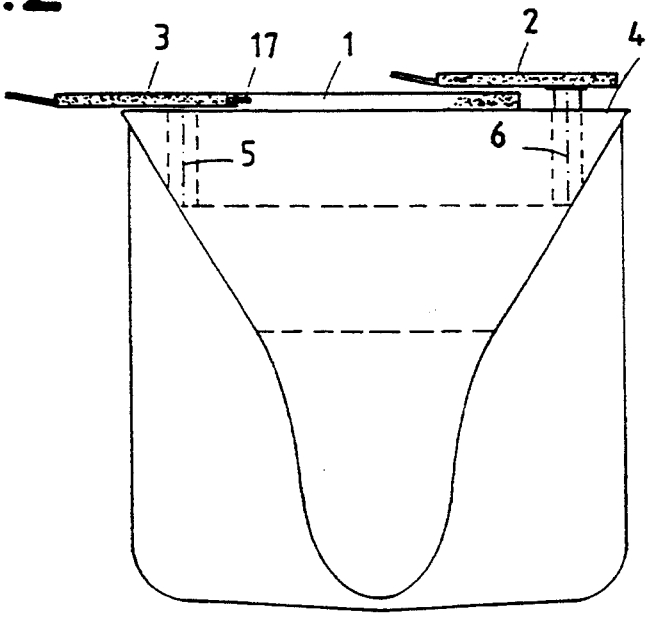
FIG. 2 is a cross-section according to line 2—2 in FIG. 1.

The helicopter deck consists of a central deck section 1 expandable on both sides by means of movable, sheet-like deck sections 2,3. The central deck section is permanently attached to the deck or to another part of a ship 4. Each of the movable deck sections 2,3 is attached to the end of its respective vertical pillar 5,6, which is attached to the deck of the ship. Each pillar consists of an outer tube 8 secured to the deck in stationary position. Within tube 8 is slidably mounted a tube 9 that may be displaced axially with the aid of a hydraulic cylinder 10. Deck section 2 or 3 is mounted at the too of tube 9 above a Flywheel rim 11 having an internal tooth system 12. In engagement with the tooth system 12 is a gear 13 driven by a motor 14, e.g., a hydraulic motor.

Figure 3:
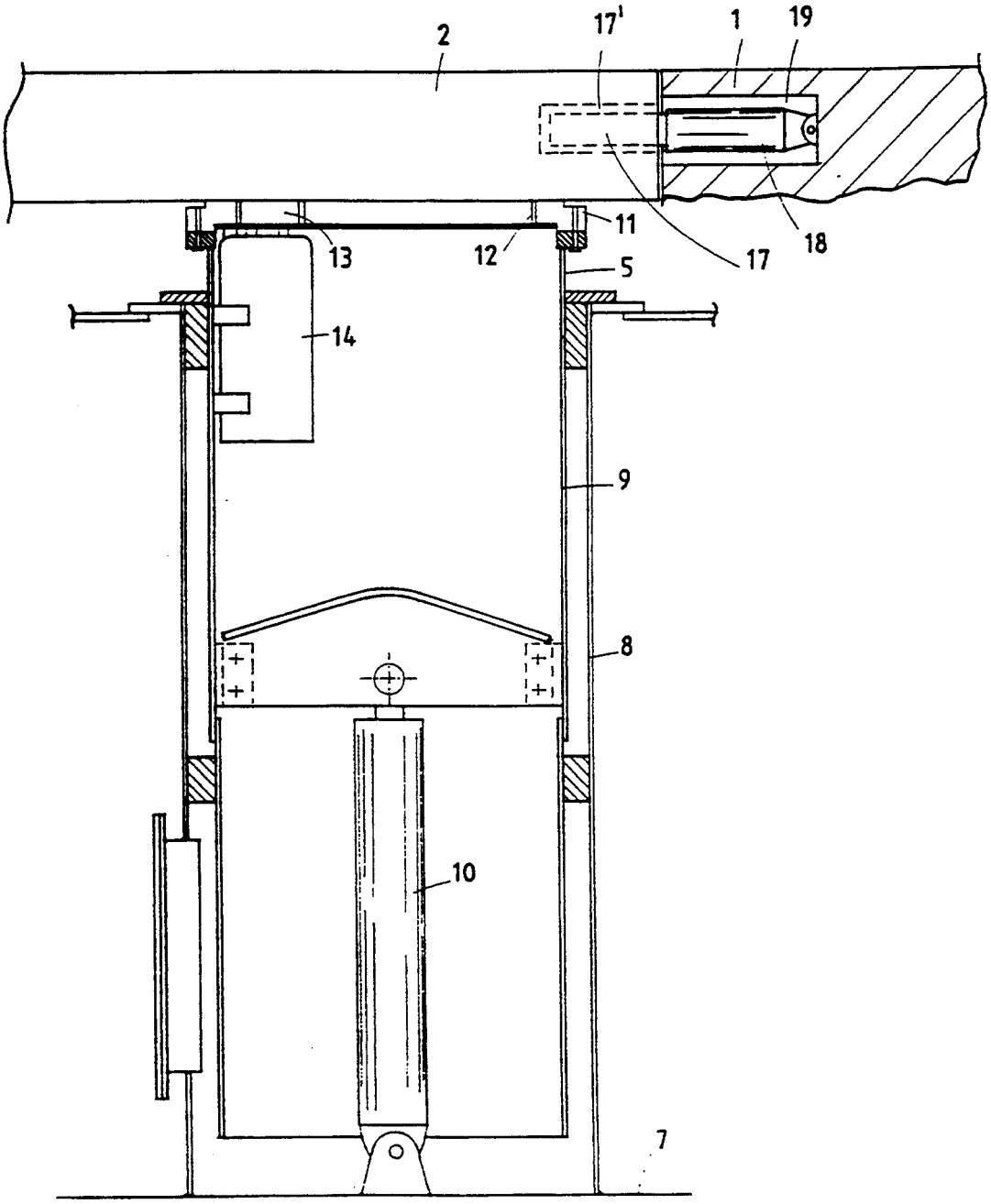
FIG. 3 is a cross-section through a lifting pillar.

The longitudinal edges 15 of the central deck section 1 and one of the longitudinal edges 15 of the movable deck sections are mutually adapted to fit together precisely when deck sections 2,3 are rotated into operative position, as is deck section 2 in FIG. 1. In this position the deck sections are secured in relation to each other, as necessary, with the aid of axially displaceable bolts 17. In the embodiment example each bolt 17 may be moved with the aid of a hydraulic cylinder 18, provided in groove 19 in the permanent deck section 1. From an inactive position with the bolt drawn inward into the hydraulic cyllnder 18, the bolt is pushed out to the position shown in FIG. 3, where bolt 17 is inserted into bore 17' in deck section 2.

As is apparent from the upper part of FIG. 1, deck sections 2 and 3 are pivoted in over deck section 1 when the helicopter deck is not in use. As is apparent from FIG. 1, in inactive position deck sections 2 and 3 will lie entirely within the outer confines of the ship 4. When the helicopter deck is to be converted from its operative position, deck sections 2 and 3 are raised with the aid of pillars 5 and 6 until they clear the permanent deck section 1. They are then rotated to stowing position by means of the pivot apparatus 12, 13, 14. From a position with both deck sections 2 and 3 in stowing position, the same procedure is carried out in reverse sequence to bring the helicopter deck into operative state.

As is clearly apparent from FIG. 1, pillars 5 and 6 are situated at a distance a from edge 16 which is considerably smaller than the distance b from pillars 5,6 to the outer edge of deck sections 2,3. This is why deck sections 2,3 in their inoperative (swung-in) position project from pillars 5,6 to a considerably smaller extent than when the deck sections are rotated out, as is shown in FIG. 1 with regard to deck section 2.

I claim:

1. A helicopter deck for a ship, having a greater transverse extension than the breadth of the ship, comprising a level, horizontal deck section (1) attached to the ship (4), longitudinal edges (15) of said deck section being substantially within the outer confines of the ship, in that there is disposed along at least one of the longitudinal edges of said deck section (1) at least one movable, sheet-like deck section which at one longitudinal edge thereof is tightly jointed to the longitudinal edge (15) of the deck section (1), that the outer, free edge of the movable sheet-like deck section (2, 3) projects substantially beyond the side of the ship, that the movable sheet-like deck section (2, 3) is rotatable in this position, the center of rotation for the movable deck section (2, 3) being located such that the movable sheet-like deck section (2, 3) in a rotated position is situated substantially within the sides of the ship, wherein the movable deck section (2,3) is supported by a verticals, extendable pillar (5, 6) and that said movable deck section (2, 3) is rotatably mounted on the upper end of said pillar.

2. The helicopter deck according to claim 1, wherein said movable deck section (2, 3) is connected to the top of said pillar (5, 6) over a toothed flywheel rim (11) which is rotatably driven by means of a motor (14).

3. The helicopter deck according to claim 1, wherein said pillar (5,6) is telescopically and hydraulically driven.

4. The helicopter deck according to claim 1, wherein said movable deck section (2, 3) in an out-swung position rests with a longitudinal edge (16) thereof on permanent supports provided on the ship (4).

5. The helicopter deck according to claim 1, wherein said movable deck section (2, 3) may be secured as necessary in an out-swung position with movable bolts (17) which in a locking position provide connections between said deck section and said movable deck section (2, 3).

6. The helicopter deck according to claim 1, wherein said deck section (2,3) may be rotatated in an angle of approximately 180°.

7. The helicopter deck according to claim 1, wherein there are a plurality of said movable deck section (2, 3).

* * * * *